United States Patent [19]

Paige

[11] Patent Number: 5,067,654

[45] Date of Patent: Nov. 26, 1991

[54] PRESSURE WASHER

[75] Inventor: Clive R. Paige, Berkshire, England

[73] Assignee: Shop Vac Corporation, Williamsport, Pa.

[21] Appl. No.: 577,801

[22] Filed: Sep. 4, 1990

Related U.S. Application Data

[63] Continuation of Ser. No. 297,620, Jan. 17, 1989, abandoned.

[51] Int. Cl.[5] ..... F04B 49/00

[52] U.S. Cl. ..... 239/124; 417/440; 417/307; 137/625.38

[58] Field of Search ..... 239/124–127; 73/714, 744, 749; 137/540, 625.38; 417/440, 439, 539, 307; 277/205, 15; 92/168, 126

[56] References Cited

U.S. PATENT DOCUMENTS

| | | | |
|---|---|---|---|
| 1,917,057 | 7/1933 | Pendergast | 417/439 |
| 3,028,758 | 4/1962 | Passaggio | 73/744 |
| 3,372,875 | 3/1968 | Torrey | 239/126 X |
| 3,556,690 | 1/1971 | Schiffer | 417/439 X |
| 3,827,827 | 8/1974 | Hill | 417/307 X |
| 3,887,304 | 6/1975 | Ito | 417/439 |
| 4,013,386 | 3/1977 | Hardman et al. | 92/168 X |
| 4,274,560 | 6/1981 | Cater | 277/205 X |
| 4,589,825 | 5/1986 | Schmidt | 417/307 X |

FOREIGN PATENT DOCUMENTS

| | | | |
|---|---|---|---|
| 908499 | 8/1972 | Canada . | |
| 207501 | 1/1987 | European Pat. Off. | 239/124 |
| 2746037 | 4/1979 | Fed. Rep. of Germany | 239/124 |

*Primary Examiner*—Andres Kashnikow
*Assistant Examiner*—Kevin P. Weldon
*Attorney, Agent, or Firm*—Ostrolenk, Faber, Gerb & Soffen

[57] ABSTRACT

A pressure washer for delivering liquid under high pressure has an inlet conduit connected to a liquid supply, an outlet conduit connected to a spray nozzle with a valve which is selectively openable for spraying liquid and a plurality of piston operated pumping cylinders connected in parallel between the inlet conduit and the outlet conduit. A bypass conduit recirculates liquid from the outlet to the inlet conduit. A valve in the bypass conduit selectively permits leakage from the outlet conduit when the spray nozzle valve is open and opens communication between the outlet conduit and the bypass conduit when the spray nozzle valve is closed and pressure builds up in the outlet conduit. Each piston in a pumping cylinder is driven to reciprocate through its pumping cylinder. The piston also moves laterally because there is an eccentric connection between the piston and a common rotary pin for each of the pistons of each of the pumping cylinders. Appropriate valves direct liquid flow only from the inlet conduit through the pumping cylinders to the outlet conduit. Additional liquid may be supplied to and mixed with the liquid in the outlet conduit through a valve at a venturi connection in the outlet conduit. A pressure gauge connected with the outlet conduit measures pressure there.

21 Claims, 6 Drawing Sheets

102
80
96
86
84
85
10
74
94
92
82
83
72
76
28
24
12
26
122
123
124
125
120
121
112
114
116
18
20
16
22
48
44
46
42
54
30
32
35
33
52
40
53
55
36
34
62
14
INPUT
68
66
60
64
56
OUTPUT
127
126
110
118

PRESSURE WASHER

This is a continuation of application Ser. No. 297,620 filed on Jan. 17, 1989 now abandoned.

BACKGROUND OF THE INVENTION

The present invention relates to a pressure washer which pumps liquid supplied from an external source through a spray nozzle at high pressure. The pressure washer may be in a standing form with an elongate hose leading to a spray lance or spray nozzle, or it can be a portable, hand held unit. The liquid may be pumped at a pressure in the vicinity of 1,000 psi. The pathway through which the liquid is pumped is typically selectively openable to permit the liquid to be sprayed from the spray nozzle and closable to halt the spray of liquid. In a portable version, the pump is typically operated when liquid spraying is required. The pump is thus switched on and off as needed by an electric switch. On the other hand, in a standing form of the pressure washer, the means which pumps the liquid typically operates continuously whether the liquid pathway is opened or closed, requiring protection of the system against damage when the liquid pathway is closed. One known technique for protecting the continuous system comprises selective bypassing of pumped liquid back to the pump inlet when the liquid outlet pathway is closed. A valve controls the bypass arrangement to permit bypass recirculation at a lower pressure to prevent overheating due to recirculation of high pressure. A valve for the bypass arrangement can desirably control that pressure to maintain its desired level.

Often the pressure washer is used to pump liquid, and particularly water at high pressure. Where the water is used for cleaning purposes, it may be desirable to mix another liquid, like a detergent or the like chemical, with the water, and appropriate means are desirable for controllable mixing of the additional liquid with the water being pumped. Various means for supplying an additional liquid into the main liquid flow are known in the art.

Various pressure washers are known. They use various pump arrangements for delivering liquid under pressure. Some known pressure washers use a piston pump, where the piston is caused to reciprocate by various means. Although one piston would pump the liquid, it is preferred to have a number of pistons. This provides the optimum balance of speed, torque, bearing life, valve design, and the like, to provide the desired flow rate and high efficiency. This also produces a generally more continuous spray. Therefore, a plurality of pistons pump the liquid and appropriate means sequence the piston operation.

In one known arrangement, the piston in such a pump is an articulated piston But the articulation connection gives rise to side thrusts and loss of efficiency, as well as being more complex. In another known arrangement, the pistons are not articulated. Instead, a swash plate rotates past the pistons to reciprocate them in sequence for pumping liquid.

SUMMARY OF THE INVENTION

It is an object of the present invention to pump liquid through a spray nozzle under elevated pressure.

Another object of the invention is to maintain the pressure in the outlet conduit, which leads to the spray nozzle, approximately at a predetermined level, while the nozzle is open and also while the nozzle is closed so that the water is recirculated at a lower pressure to prevent rapid overheating.

Another object of the invention is to enable recirculation of the liquid in a pressure washer when the liquid pathway to the spray nozzle is closed while the liquid is still being pumped from the inlet conduit to the outlet conduit.

A further object of the invention is to enable mixing of additional liquid with the liquid being pumped by the pressure washer.

A further object of the invention is to provide a piston in each pump cylinder of a pressure washer which piston avoids the need for an articulated connection of the piston.

A related object is to seal each pump cylinder around the respective piston.

In a pressure washer, according to the present invention, there is a cylinder block of the pressure washer which includes an inlet conduit for delivery of liquid drawn from a source, an outlet conduit for delivery of liquid to the dispensing spray nozzle and at least one, and usually a plurality, of pumping cylinders connected in parallel across the inlet and outlet conduits. The spray nozzle from the outlet conduit has a valve which is selectively opened for permitting outlet of pumped liquid or closed for blocking outlet flow.

A liquid flow bypass and recirculation arrangement is provided for recirculating flow from the outlet conduit to the inlet conduit. It is needed because the pumping cylinders continue to pump liquid whether the spray nozzle valve is opened or closed.

The bypass arrangement includes a valve element piston which is biased by a spring toward a valve seat that is exposed to the pressure in the outlet conduit. The opening of the valve seat into the outlet conduit permits the liquid in the outlet conduit to contact the face of the valve element The cross-section of the opening through the seat is smaller than the cross-sectional area of the face of the valve element piston. Further, the valve element piston is shaped so that there is a liquid leakage passageway through the valve element piston to a bypass conduit. Finally, the valve element piston, biased toward the valve seat normally blocks all communication from the outlet conduit to the bypass conduit. As will be described below, when the pressure on the large area face of the valve element piston is sufficiently high, due to elevated flow through the valve seat, to exceed the capacity of the leakage passageway to transmit all of the liquid that leaks past the valve seat at the predetermined pressure, the valve element is raised off the valve seat sufficiently against the spring pressure to open communication between the outlet conduit and the bypass conduit.

With the spray nozzle valve open, the pumped flow in the outlet conduit is largely dispensed through the spray nozzle valve and out the spray nozzle Due to the back pressure of the spray nozzle, there is elevated pressure in the outlet conduit, at the predetermined level which is established by the biasing spring acting upon the valve element, and the flow of pressurized liquid in the outlet conduit seeks to drive the valve element away from its seat by acting upon the face of the bypass element through the narrowed opening from the outlet conduit. There is a small leakage flow of liquid from the outlet conduit past the slightly upraised face of the piston valve element. That flow is small enough to simply leak through the leakage passage through the valve element piston, and the biasing spring holds the valve element piston down sufficiently to block communication between the outlet conduit and the bypass conduit.

When the spray nozzle valve is closed, while the pump continues to pump liquid at the same level, liquid no longer the escapes through the spray nozzle so that a much greater volume of liquid must escape from the outlet conduit. The leakage passage through the valve element piston is not large enough to permit leakage therepast of all of the liquid flowing past the valve element piston The liquid pressure builds up beneath the valve element piston, which is pushed up against the bias of the spring The piston rises sufficiently off its seat that the entire larger area face of the valve element piston is exposed to the flow under pressure from the outlet conduit. Liquid pressure over the larger surface area overwhelms the force of the spring on the valve element The valve element piston rises sufficiently to permit liquid flow communication between the outlet conduit and the recirculation bypass conduit, and liquid flows from the elevated pressure outlet conduit into the low pressure bypass conduit which communicates into the low pressure inlet conduit. The spring holds the valve element piston at a position at which the substantially desired level of pressure is maintained in the outlet conduit by the spring acting upon the valve element piston and that also maintains the same level of pressure in the outlet conduit.

When the spray nozzle valve is reopened to permit spraying out the spray nozzle, there is a sudden reduction of the volume of liquid moving out the outlet conduit past the valve element piston and into the bypass conduit. The spring drives the valve element piston back toward its seat. The liquid flowing out of the outlet conduit past the valve seat is again small enough that it can be entirely passed by the leakage passage through the valve element, and the valve element piston is therefore enabled to return toward its seat, from which it remains slightly upraised by the small volume of liquid flowing past the valve element piston to the leakage passage.

The valve element piston, therefore, serves as a pressure regulator for the outlet conduit and is responsive to the flow of the liquid from the outlet conduit, and in doing so the piston and its leakage passage maintain the pressure in the outlet conduit at the desired level. As the pressure in the outlet conduit slightly raises the piston, the leakage flow that is permitted to pass into the area beneath the bypass element piston then passes through the leakage passage and the bypass element piston is therefore held down. It is only when the leakage passage is overwhelmed by an elevated quantity of liquid, due to the pressure spray nozzle being closed, that the valve element piston rises sufficiently to provide communication with the lower pressure, bypass conduit leading to the inlet conduit.

The spring pressure of the valve element is adjusted to establish the desired pressure level in the outlet conduit.

In order to mix an additional liquid, such as a detergent or chemical, with the liquid exiting through the outlet conduit, there is a valve connection to the outlet conduit which is connectable to and openable to a supply of the additional liquid. The outlet conduit has within it a reduced cross-section spray nozzle followed by a narrowed venturi. When liquid flows through the spray nozzle and continues through the venturi, this causes a reduced pressure region in the vicinity of the outlet of the spray nozzle at the venturi. The valve connection in the vicinity of the venturi includes a valve element which permits entry past the valve connection of additional liquid. A reservoir of the additional liquid is connectable with the valve connection to supply that additional liquid to the outlet conduit.

The spray nozzle for the pressure washer has a high pressure spray mode and a low pressure spray mode. At the high pressure mode, the pressure in the outlet conduit closes the valve element of the valve connection against its seat so that no additional liquid is drawn into the outlet conduit from the reservoir. At the low pressure mode, the reduced pressure in the outlet conduit at the venturi opens the valve element off its valve seat and draws additional liquid from the reservoir through the valve connection into the outlet conduit. The valve connection communicating with the reservoir of additional liquid is disposed in the outlet conduit so that when the valve to the spray nozzle is closed and the liquid is recirculating through the bypass conduit, liquid does not also pass through the venturi. To this end, the bypass conduit may be connected between the inlet and outlet conduits beyond and at one side of the array of pumping cylinders while the venturi is disposed beyond the opposite side of the array of pumping cylinders.

There is additionally a pressure measuring gauge communicating into the outlet conduit upstream of the reduced cross-section spray nozzle. That gauge may include a pressure responsive movable gauge element, which is raised in one direction proportionally to the pressure in the outlet conduit against a biasing force directed in the opposite direction An indicator communicates with the movable gauge element so that the position of the movable gauge element is calibrated in terms of the pressure in the outlet conduit. For example, when the gauge element is a gauge piston which moves in one direction along a cylinder against the bias of a spring, the indicator may be on a disk which is rotated about its axis through an eccentric connection with the gauge element, and the disk is calibrated with an indicator to indicate the pressure.

Each of the pressure cylinders includes a respective pumping piston which reciprocates through a respective pumping cylinder to alternately increase and decrease the volume inside and thus the pressure in the pumping cylinder. An input valve located in the respective input conduit between the inlet conduit and each pumping cylinder is normally biased closed and is caused to open as the pressure in the pumping cylinder reduces, which permits liquid to enter the pumping cylinder from the inlet conduit. An output valve located in the respective output conduit between each pumping cylinder and the outlet conduit is normally biased closed and is caused to open as the pressure in the pumping cylinder increases, which expels liquid from the pumping cylinder through the output conduit and into the outlet conduit.

To avoid the need for an articulated connection between the means for driving all of the pistons to reciprocate and each piston, each piston extends from its pumping cylinder and is connected eccentrically to a crank pin, so that as the crank pin rotates, the piston reciprocates through the pumping cylinder, and the piston also wobbles or moves laterally. The piston head end extends into the pumping cylinder. The head end has a cover over it that moves with the piston.

An appropriate resilient sealing element encircles the periphery of the piston head cover and extends from the cylinder into contact with the piston head cover to prevent leakage of the liquid in the pump cylinder past the piston Such leakage would otherwise occur because of the clearance that is defined in the pump cylinder for permitting the piston to move laterally. Engagement of the piston head cover with the encircling seal defines a fulcrum for the lateral shifting of the piston as it reciprocates.

In the particular embodiment shown herein, the crank pin supports an eccentric bush which is attached to rotate with the crank pin A ball race is disposed around the eccentric bush The piston is supported on the ball race Rotation of the eccentric bush moves the ball race eccentrically and causes the piston to both reciprocate and rock laterally A plurality of pumping cylinders are provided for reasons that were mentioned above. Each of the pistons is driven to reciprocate time offset from the other pistons, by all of the pistons being connected to the same crank pin at angularly offset positions.

The foregoing and other objects and features of the present invention will become apparent from the following description of the preferred embodiments of the invention considered in conjunction with the accompanying drawings.

DESCRIPTION OF THE PREFERRED EMBODIMENT

Figures 1, 1A:
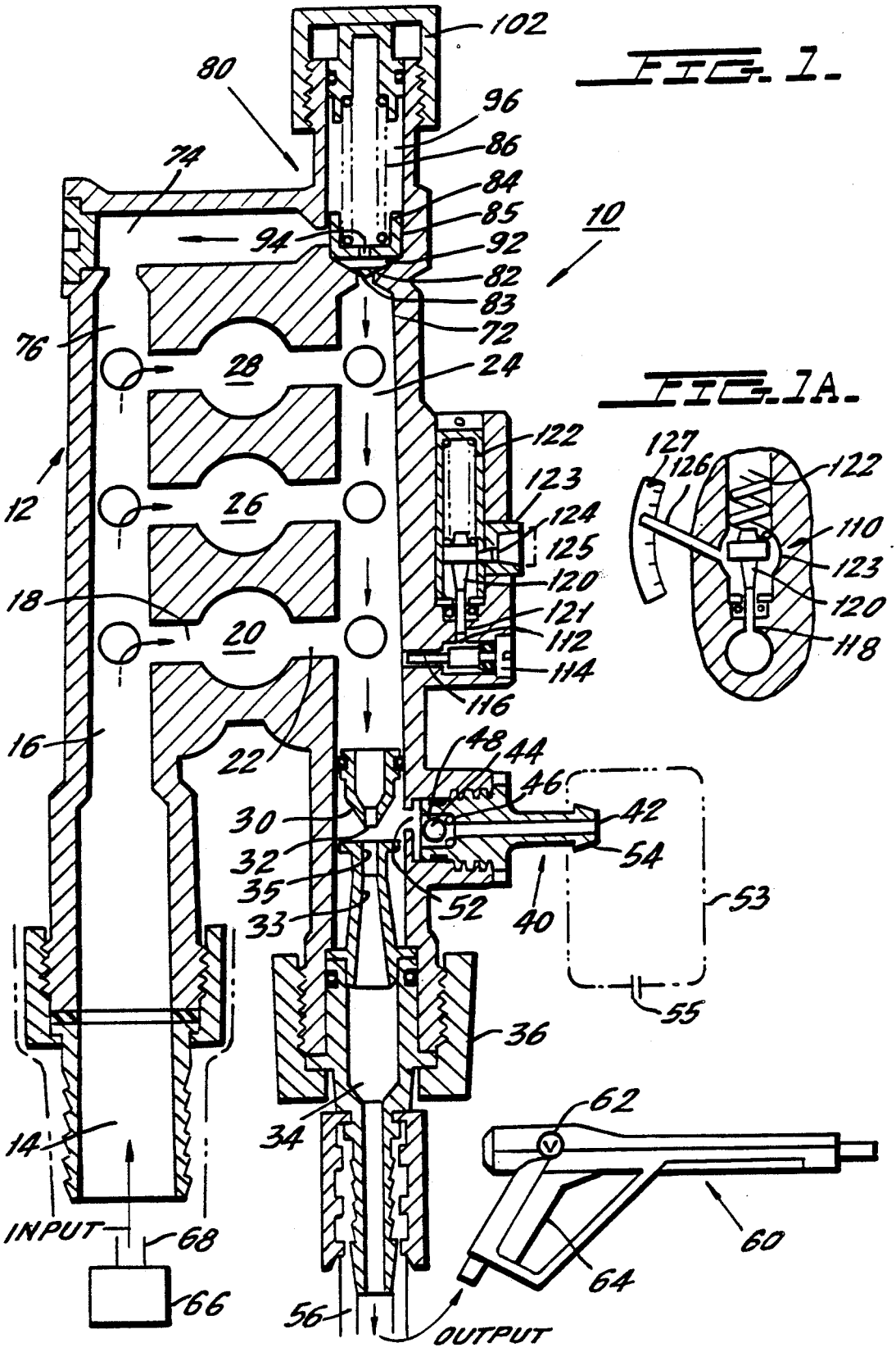
FIG. 1 is a schematic longitudinal cross-section in plan view of a pressure washer according to the invention.
FIG. 1A is a fragmentary view in direction 1A—1A of FIG. 1, showing a pressure gauge.

The pressure washer 10 has a cylinder block or housing 12. The housing 12, in turn, is disposed inside an outer housing 190, described below. The housing 12 has an inlet fitting 14 which is connected with a supply of wash liquid, typically water It may typically be connected to a water tap of a conventional water supply or to a hose leading from a reservoir. The inlet fitting 14 communicates into the inlet supply conduit 16 which supplies each of the three below described pumping cylinders 20, 26, 28 with water. Each cylinder has its own input conduit 18 communicating with the inlet conduit 16 for supplying the pumping cylinder 20. The output from each cylinder 20 is through its own output conduit 22 which communicates with the common outlet conduit 24.

There are three cylinders 20, 26 and 28 connected in parallel between the inlet conduit 16 and the outlet conduit 24. The wash liquid is pumped through all three cylinders 20, 26, 28 and out the outlet conduit 24, which develops a significant pumping pressure. In the outlet conduit 24, past the pumping cylinder output conduit 22 which is furthest toward the main outlet spray nozzle of the pressure washer, there is a tapered nozzle 30. The outlet 32 of the nozzle 30 emits a high pressure spray into the narrowed throat of the venturi 33 at the entrance end of the continuation outlet conduit 34 of the outlet fitting 36. The flow restriction at the nozzle outlet 32 followed by the venturi can suck into the venturi 33 and the outlet conduit 34 an additional liquid, such as a chemical or detergent, to mix with the liquid, such as water, that is being pumped through the pressure washer. That entrainment of additional liquid occurs upon lower pressure spraying by nozzle 60, but is prevented by higher pressure spraying, as described below.

By means of an adjustable flow restriction in the below described spray nozzle 60, the spray can be of greater volume causing lower pressure in conduit 34 or can be of lesser volume causing higher pressure in that conduit. With the valve to the spray nozzle blocked, pressure in the conduit 34 is higher still.

The valve connection 40 for the additional liquid comprises the inlet fitting 42 for inlet of additional liquid and includes the valve element 44 which rests against its seat 46 to close the fitting 42. The element 44 resides in a chamber 48 which communicates into the throat of the venturi 33 through a passage 52.

Figure 3:
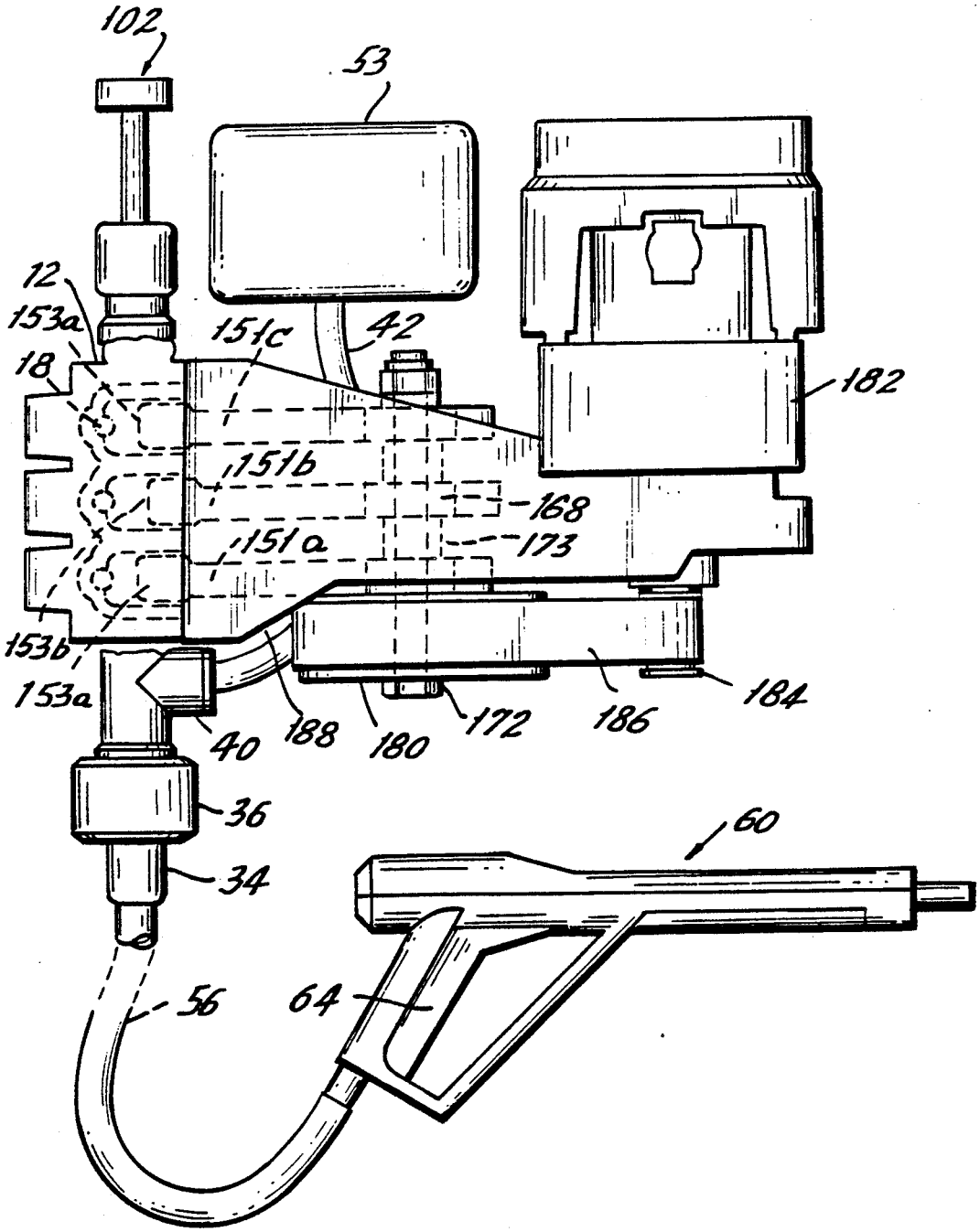
FIG. 3 is a top view of the pressure washer with the outer covering off.
Figure 4:
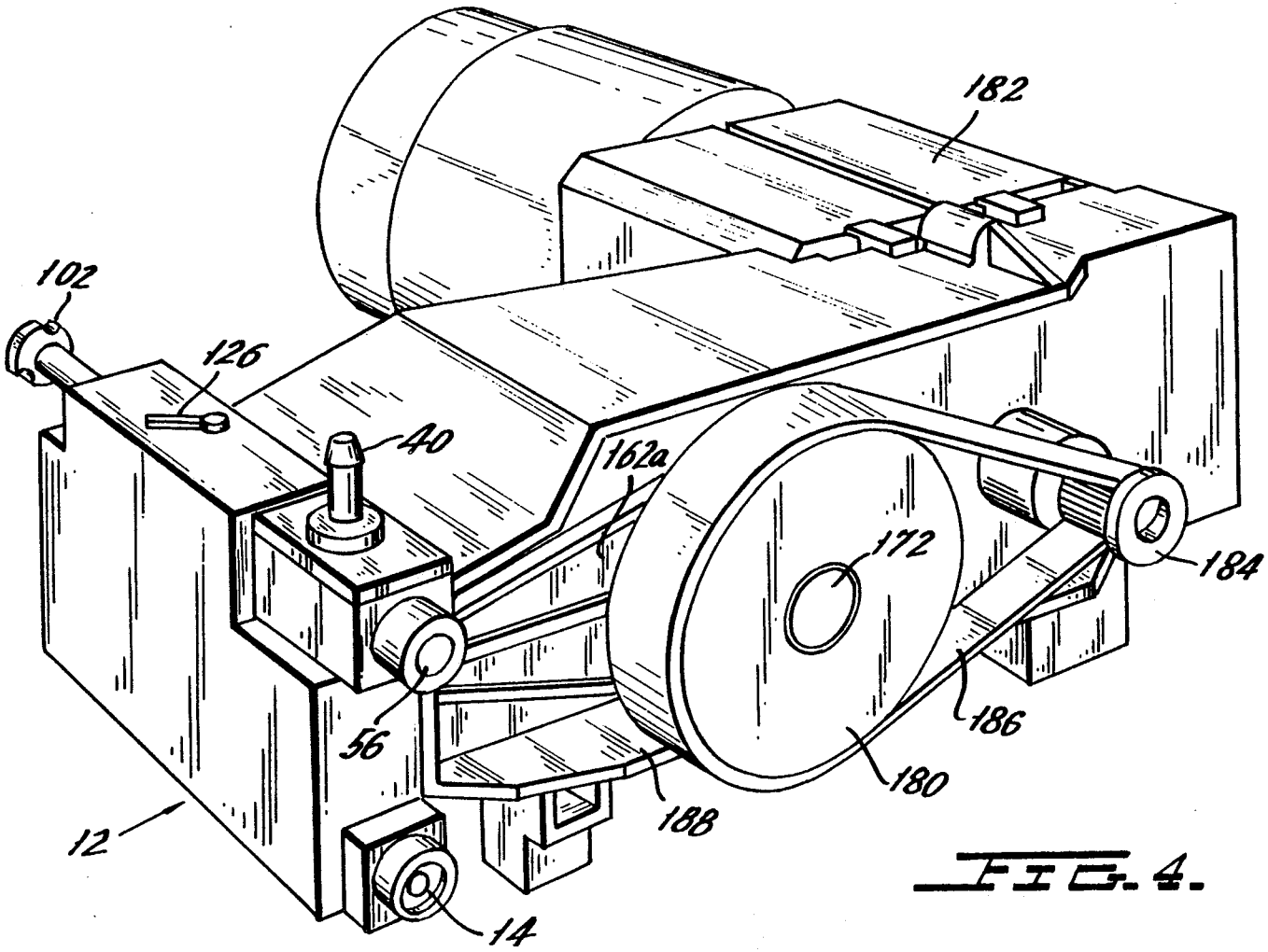
FIG. 4 is a side perspective view.
Figure 5:
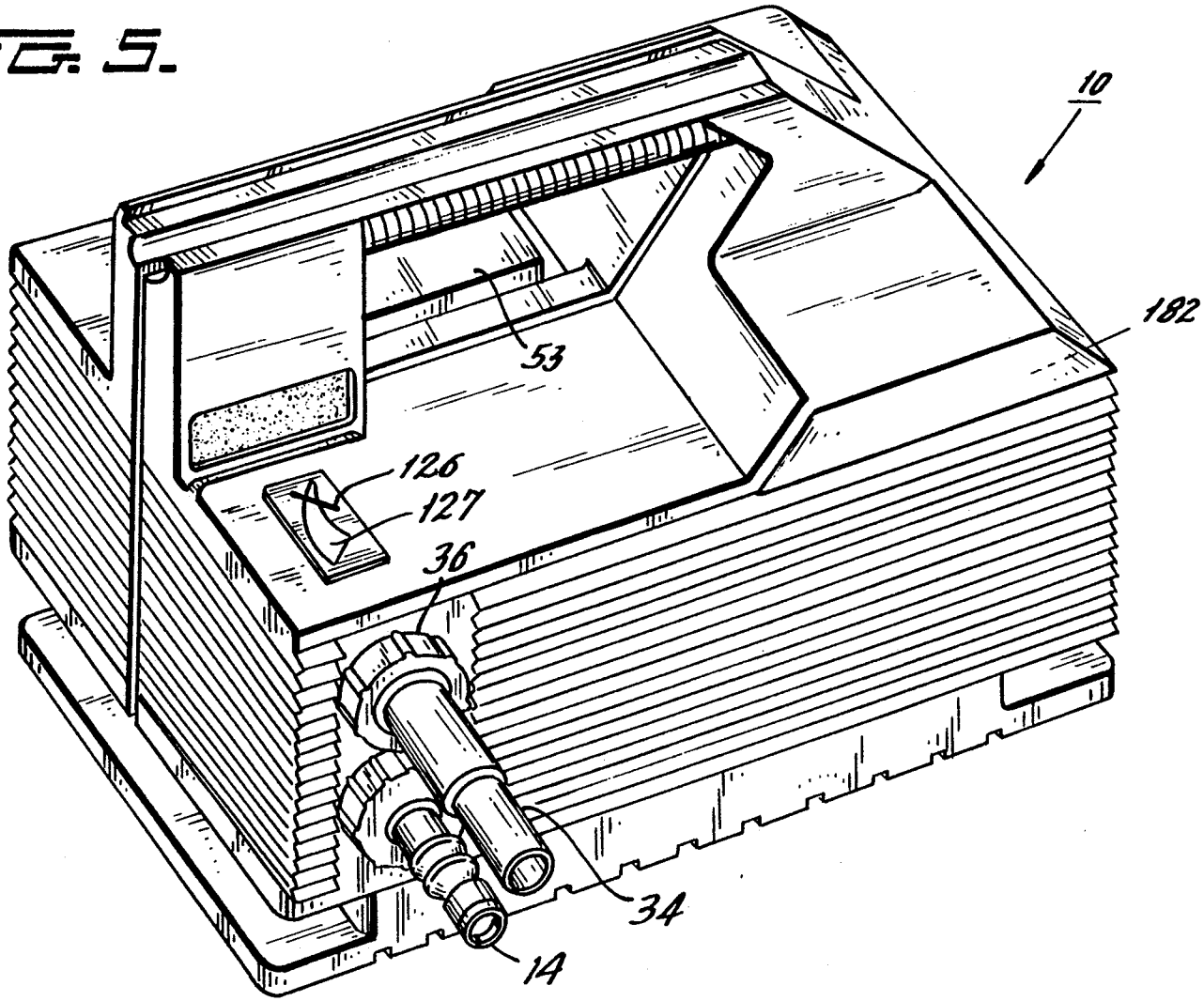
FIG. 5 is a perspective view with a covering housing thereover.
Figure 6:
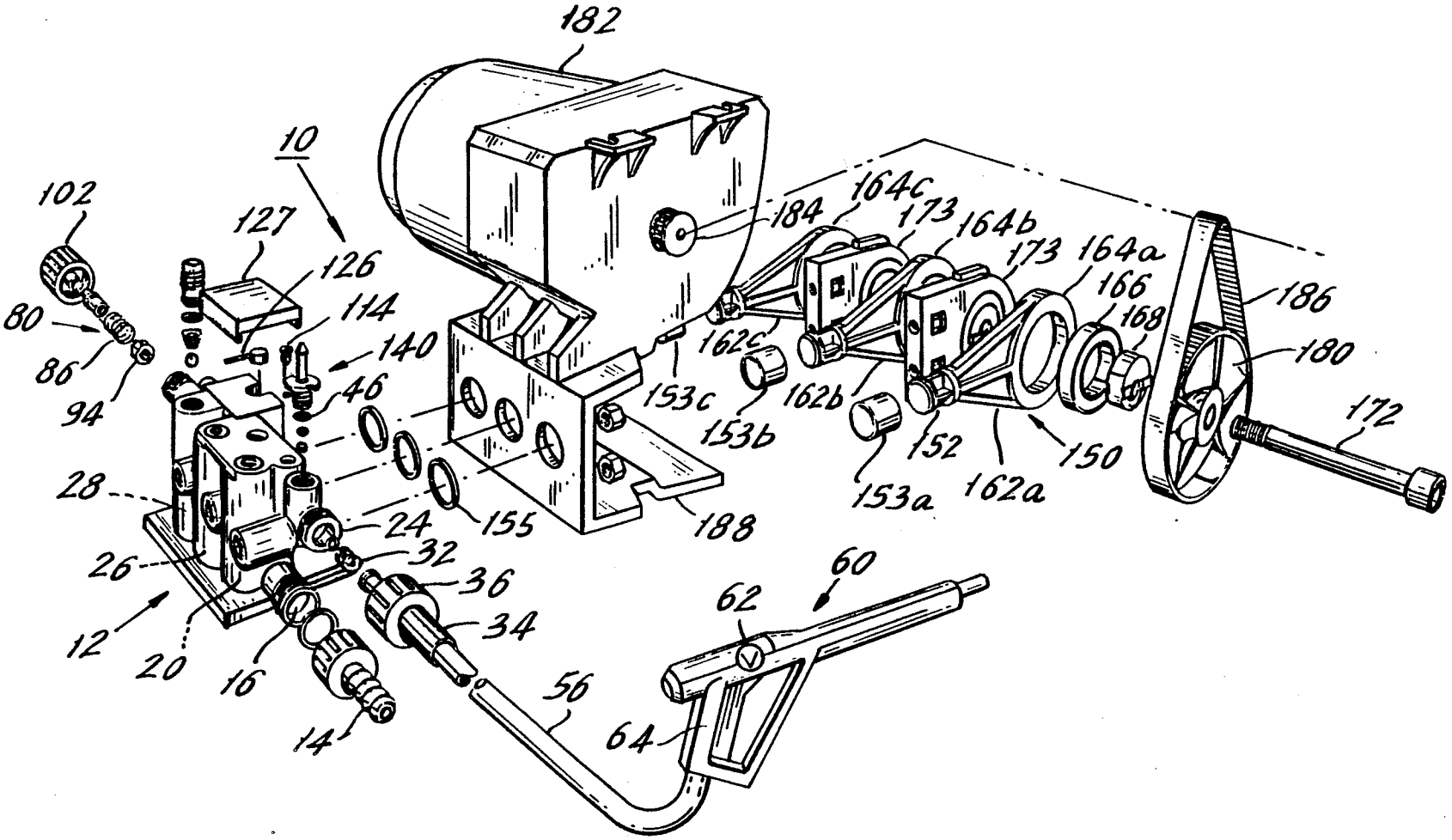
FIG. 6 is an exploded perspective view of the pressure washer.

As seen in FIGS. 3 and 5, there is a reservoir 53 of additional liquid which is optionally removably emplaced next to the pressure washer. It includes an outlet 54 which is removably connected on the inlet fitting 42. The reservoir has a selectively openable and closable air inlet 55 When that inlet is open, the liquid in the reservoir may be sucked into the fitting 42. When that inlet is closed, no liquid can be sucked from the reservoir 53.

At higher pressure, with the valve to the spray nozzle closed and liquid or water recirculating, or with the spray nozzle at a high pressure spraying mode, the pressure of the liquid in the passage 52 and the chamber 48 is high enough to close the valve element 44 on its seat 46. This prevents liquid from entering the reservoir from the passage 52. Obviously, there is no flow out of the reservoir into the passage 52. If the reservoir is removed, and the pressure in the passage 52 is low, air is sucked into the system through valve 40 during low pressure spraying. With the reservoir 53 in place during low pressure spraying, the venturi effect in the venturi 33 creates enough suction in passage 52 and on valve element 44 to open the valve element off its seat and to enable the additional liquid to be entrained into the water flow. The outlet 32 of nozzle 30 is directed to spray through the throat 35 at the center of the venturi 33, and that throat is slightly larger than the diameter of the outlet 32. Water passing through the venturi causes an increased pressure drop around the nozzle 30, and that draws the valve element 44 off its seat 46 and draws additional liquid from the reservoir 53 past valve 40 and into venturi 33 and outlet conduit 34.

The outlet conduit 34 is connected at the fitting 36 into a high pressure hose 56 The hose communicates to a conventional outlet spray pressure nozzle 60 which has a valve 62 that is normally closed and that includes a valve operator or trigger 64 which operates the valve 62 open to spray the liquid under pressure when the valve is open. When the nozzle valve 62 is open, liquid passes from the source 66 through a conduit 68, into the inlet fitting 14, the supply conduit 16, through each of the cylinders 20, 26 and 28, through the outlet conduit 24, 34, through the hose 56 and the nozzle. Additional liquid is selectively drawn from the liquid supply through the fitting 40. As described above, the nozzle 60 has two selectable positions for higher and for lower spray pressure. Various means may impose the pressure raising restriction on the flow through the nozzle.

During a significant part of the time that the cylinders 20, 26, 28 are pumping liquid in the manner described below, the valve 62 to the pressure nozzle 60 is closed so that none of the liquid being pumped can exit from the pressure washer system. In order to enable the continuous operation of the pump cylinders, the liquid being pumped through the cylinders into the outlet conduit 24 is recirculated back to the lower pressure inlet conduit 16 to be pumped through the cylinders again. For this purpose, the outlet conduit 24 is connected with a higher pressure bypass conduit 72 that is on the higher pressure outlet side of the pump. The conduit 72 has a right angle bend past the below described bypass valve 80 and into the lower pressure, continuing, bypass conduit 74 and another right angle bend into the further continuing, lower pressure, bypass conduit 76, which communicates into the inlet conduit 16. The conduits 74 and 76 are at a lower pressure as they are on the side of the valve 80 communicating with the inlet conduit 16, from which liquid or water is being withdrawn.

A liquid flow bypass valve 80 disposed in the bypass conduit 72, 74, 76, and particularly at the junction between conduits 72 and 74, closes the bypass conduit when the valve 62 to the pressure nozzle 60 is opened, but opens the bypass conduit when the pressure nozzle valve 62 is closed for permitting recirculation of the pumped liquid or water. The valve 80 includes a narrowed cross-section, i.e. a narrowed diameter, valve seat 82 in the conduit 72. A valve element 84 in the form of a piston is located in the bore 85. The valve element has substantially the cross-section, i.e. the diameter, of the bore 85 so that essentially no water can escape past the outside of the valve element 84. An O-ring (not shown) around the valve element 84 could enhance leakage prevention The valve element in the bore 85 is biased toward the seat 82 by the compression spring 86. So long as the bottom of valve element 84 is below the bottom edge of the narrowed entrance into the conduit 74, the valve element 84 closes the bypass conduit 72, 74, 76. The seat 82 is narrowed in crosssection so that under the operating pressure and flow volume passing the valve 80 with the pressure spray nozzle 60 open, there is only a small surface area bottom face 83 of the valve element 84 for liquid under pressure in conduit 72 to operate upon. As the flow of liquid in conduit 72 increases, which increases the pressure in conduit 72 and at valve element 84, the valve element 84 starts to rise off its seat 82 and the liquid under pressure leaks into a narrow passageway 92 into the bottom of the valve element 84 and that passageway 92, in turn, communicates with a narrow bore leakage passage 94 through the valve element 84 that allows the leaked liquid to escape into the unpressurized bore 96.

Because the pump cylinders 20, 26 and 28 generate the same level of liquid flow whether the pressure nozzle valve 62 is open or shut, the flow bypass valve 80 essentially serves as a flow detector which detects when the rate of flow through the pressure nozzle 60 changes and bypasses flow out of the conduit 72 when there is excess flow The bypass valve element 84 itself is pressure responsive, but it reacts to the change in flow.

The first condition of operation is with the pressure nozzle valve 62 open. Most of the liquid being pumped through the pump chambers 20, 26, 28 moves through the conduits 24 and 56 and the pressure nozzle valve 62 through the pressure nozzle 60. The orifice of the pressure nozzle 60 or some other passage elsewhere in the outlet path is of a diameter to develop a back pressure in the outlet conduit 24 or the bypass conduit 72, which is sufficient to raise the valve element 84 to a short height off the seat 82, against the bias of the spring 86 In this operating condition, only the narrow diameter portion of the bottom 83 of the valve element, which is fully exposed to the conduit 72 and to the pressure in that conduit, and the spring 86 is able to exert sufficient pressure to hold the valve element 84 down toward the seat and to maintain the pressure in the conduit 72. The valve element 84 rises, not enough to expose the full underface 83 of the valve element 84 to the full pressure in the bypass conduit 72, but still enough that liquid leaks into the space just below the face 83 of the valve element 82, through the passage 92 and through the passage 94 into the bore 96. This continuous relief through the passages 92 and 94 of the liquid leaking past the bottom face 83 of the valve element 84 prevents development of sufficient pressure or sufficient flow of the liquid beneath the valve element 84 to raise it sufficiently to open communication between the conduits 72 and 74, whereby none of the liquid in conduits 24 and 72 is bypassed. Effectively, therefore, the leakage passage 94 is a flow detector which detects that the amount of liquid flowing past the valve seat 82 is below a predetermined flow rate, and the spring 86 operating against the valve maintains the pressure in the conduit 72 at a constant level which is regulated by the spring and the liquid leaking through the passage 94.

Next, the trigger 64 is operated to reclose the pressure nozzle valve 62, and no more liquid exits the pressure nozzle 60 However, the pump cylinders 20, 26 and 28 are still expelling their usual high volume of liquid or water under pressure. The liquid flowing into the conduit 72 presses up against the valve element 84, but now there is a much greater quantity of liquid, since none is escaping through the pressure nozzle valve 62 Almost immediately, the quantity of liquid moving past the bottom 83 of the valve element 84 is too great to all escape through the leakage passages 92 and 94. The greater flow of water pushes up the valve element piston 84 When that has risen slightly, it exposes the entire underface 83 of the valve element 84 to the pressure in the conduit 72. The pressure in the conduit 72 is now applied over the greater area of the underface 83 of the piston 84. The spring 86 does not exert sufficient pressure to overcome this pressure, and the valve element piston 84 moves backward or rises high enough so that its bottom face 83 clears the bottom of the bypass conduit 74. The heavy flow of liquid now moves around the bypass conduit 74 into the lower pressure region 74, 76 from which it is repumped through the pump cylinders 20, 26, 28. With the valve element piston 84 upraised to permit bypass flow through the conduit 74, the leakage passage 94 is not playing a significant function in the operation of the valve element 84, although leakage through that passage will continue.

The operator next reopens the pressure nozzle valve 62 for permitting liquid in the conduit 56 to eventually move the spray out the pressure nozzle 60. When the pressure nozzle valve 62 opens, liquid is sprayed out the nozzle 60. Of course, there is an immediately reduced flow from the conduit 72 through the valve seat 82. The diameter of the underface 83 of the piston is balanced against the spring pressure of the spring 86, so that as the pressure nozzle valve 62 is opened, and the flow rate past the valve element 84 is reduced, the valve element piston 84 starts to move down or forward again, because it is seeing less flow and effectively less pressure over its bottom surface. As the valve element piston 84 moves down, it closes off communication to the bypass conduit 74 and it continues down toward the seat 82 so that the pressure in the conduit 72 is again exposed not over the entire surface area of the underface 83 of the valve element piston 84, but only over the narrower cross section of the valve seat 82. As soon as the valve element piston has moved down, there is a smaller diameter of the bottom face 83 piston being operated upon by the flow under pressure in the conduit 72. The brief drop off in pressure in the conduit 72, which occurred just after the pressure nozzle valve 62 was opened, reverses and the pressure builds up again against valve element 84. Because the pressure of the spring 86 is again operating against a smaller diameter, smaller surface area surface 83 of the valve element 84, the spring maintains the higher pressure level in the conduit 72.

The passage 92, 94 is important to the ability of the valve element piston to return toward the seat 82, because even with the flow rate reduced upon the opening of the pressure nozzle valve 62, there is nonetheless flow past the opened valve element 84 But, that flow is at a rate low enough that the leakage passage 92, 94 can pass the flow into the chamber 96, which enables the valve element piston 84 to move toward the seat 82.

The passage 92, 94 is a device for helping the valve element piston 84 maintain the level of pressure in the conduit 72, so that as there are pressure variations in the conduit 72 and as the piston 84 shifts slightly up from the valve seat and back toward it, the leakage flow through the passage 92, 94 automatically adjusts and the spring 86 is thus able to maintain the valve element piston down toward the seat 82. It is only when the flow into conduit 72 suddenly increases rapidly, due to the closing of the pressure nozzle valve 62, that the leakage passages 92, 94 are not able to handle the flow, and the valve element piston rises up to permit the bypass of flow into the conduit 74. Were there no leakage passage 92, 94, any amount of flow past the valve seat 82 would build up a pressure head below the valve element piston 84 and would raise the piston up, causing bypass flow through the bypass conduit 74 The valve element 84 would not therefore maintain a pressure level established by the narrow diameter of the seat 82, but would only maintain a pressure level established by the full underface 83 of the pressure valve piston 84.

One reason for using the liquid flow bypass valve 80 is to enable the system, and particularly the conduit 72, to operate at lower pressure The pumping chambers 20, 26 and 28 are all pumping through a small orifice which generates heat It is desirable, therefore, to recycle at low pressure to generate less heat The pressure of the system, and particularly the pressure in conduit 72, should not vary due to the input pressure of the water supplied to the inlet conduit 14. For example, the system may be supplied with water from a municipal water supply, from a pumped supply, or it may simply draw liquid out of an unpressurized reservoir 66. The pressure applied on the valve element 84 by the spring 86 is adjusted to establish a desired pressure level in conduit 72.

Measuring the output pressure in the outlet conduit 72, 24 with the pressure gauge 110 of FIGS. 1 and 1A enables adjustment of that pressure, through adjustment of the regulator cap 102, should conditions warrant, to assure that an appropriate spray of wash liquid is obtained and to assure that the pressurized system does not suffer damage. The input to the pressure gauge comprises a conduit 112 which is sealed so as to not provide a leak path for the elevated pressure liquid. Installed in that conduit 112 is a pressure gauge bleed screw 114 whose periphery is provided with an elongate, small cross-section, helical screw pathway 116 which allows only a small volume of the wash liquid to pass. The elongate pathway damps the pressure pulsations generated by the pump cylinders so as to deliver a generally constant liquid pressure to the pressure gauge piston 120. The liquid that has passed the pressure gauge bleed screw 114 presses against the underside 118 of the pressure gauge piston 120 movably supported in cylinder 121. Upward movement of the piston 120 under the influence of that pressure is opposed by the pressure gauge spring 122. The height position of the pressure gauge piston 120 in its cylinder 121 is dependent upon the pressure in the outlet conduit 24.

The pressure gauge piston mechanically operates a pressure indicator. For example, one such indicator comprises a disk 123 with an axis 124 transverse to and laterally offset from the piston 120. An eccentric pin 125 on the disk is in engagement with the pressure gauge piston 120. The motion of the piston communicates through the pin 125 to rotate the disk 123. An indicator needle 126 on the disk rotates with it and that indicator needle is calibrated on a gauge 127 to indicate the pressure Alternately, there may be an indicator on the piston that moves with the piston to indicate pressure.

Figure 2:
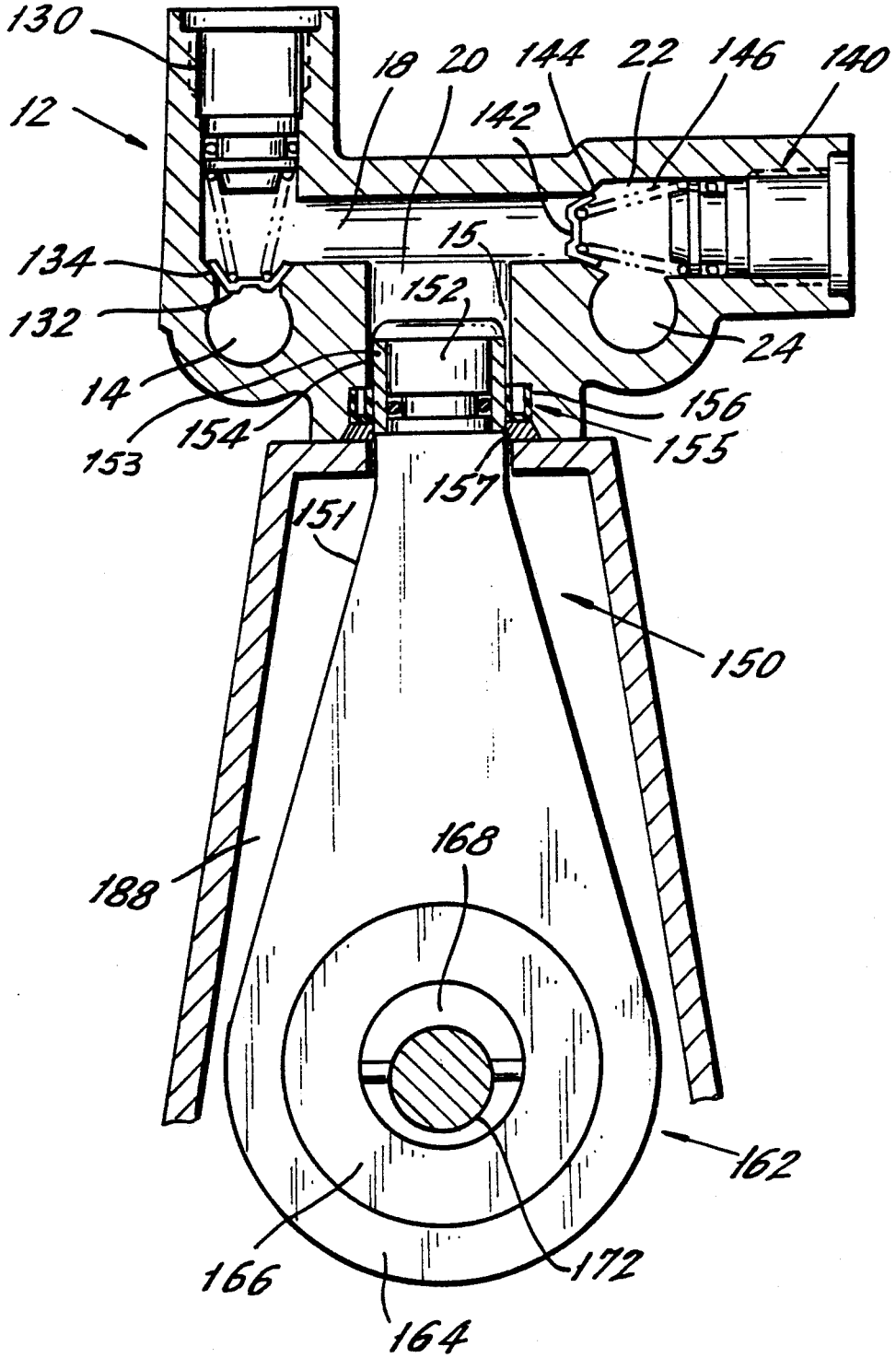
FIG. 2 is an elevational view in cross-section through one of the pumping cylinders in FIG. 1.

There are three of the pump cylinders 20, 26 and 28 which are identical in construction. One of them is now described with reference to FIG. 2. The cylinder 20 communicates through the input conduit 18 with the inlet conduit 14. A one-way input valve 130 only permits the liquid to enter the cylinder 20 when the pressure in the cylinder 20 is reduced. When the pressure in cylinder 20 is reduced, the pressure in the inlet conduit 14 presses upon the valve element 132 to raise it off its seat 134, which is toward the inlet conduit 14, and against the bias of the one-way return spring 136.

The output conduit 22 from the cylinder 20 to the outlet conduit 24 is also blocked by a one-way output valve 140. When the pressure in the cylinder 20 increases, the valve element 142 is raised off its seat 144, which is toward the cylinder 20, and against the bias of the spring 146 until the output conduit 22 communicates into the outlet conduit 24.

The curved shape of valve elements 132, 142 in the conduit pathways in which they are disposed are selected to permit movement of the valve elements without undesired cocking or sticking during the rapid repetitive valve element operation.

Pumping of liquid first into the cylinder 20 and then out of the cylinder is accomplished by the piston unit 150. It comprises the piston 151 with a head 152 that reciprocates in the cylinder 20. The piston head 152 is enclosed and surrounded by a cup shaped cover 153 comprised of a smooth surface, but hard and durable, ceramic material. The cover 153 is sized and shaped and the cylinder 20 is of a width that there are clearance spaces 154 along the sides of the piston head cover 153 to allow for the below described lateral movement or wobble without the piston contacting the sides of the cylinder.

To seal the cylinder 20 around the wobbling piston head cover 153, particularly in view of the clearance spaces 154, the piston is surrounded by a static seal 155 comprising a U-shaped strip of resilient material with one leg normally biased inwardly against the side of the piston and the other leg held in the notch 156 below the cylinder block 12. The seal 154 is supported from below by the seal support 157 in the notch 156. The pressure inside the cylinder 20 forces the inward leg of the seal against the below described sleeve 153 over the piston.

The cover 153 over the top of the piston head slides along the seal 155 as the piston reciprocates. The cover 153 contacting with the seal 155 defines a fulcrum for pivoting of the piston 151, causing a wobbling or lateral movement as the piston reciprocates.

The piston continues at piston rod 162 below the cylinder 20 into the housing 188 around it, as described below. The piston 151 is integral with the piston rod unit 162 which comprises the non-rotatable ring 164 at the bottom end of the rod of the piston 151, the ball bearing 166 within the ring 164, an eccentric bush 168 which rotates inside the bearing 166 and the rotating crank pin 172 at the center to which the bush 168 is secured Rotation of the crank pin 172 in turn rotates the respective eccentric bush 168. The eccentricity of the bush causes the ring 164 to wobble eccentrically and that carries along the piston 151 so that the piston reciprocates up and down in the cylinder 20 and also wobbles left and right as it reciprocates up and down. The seal 155 around the piston cooperates with the cover 153 on the piston to prevent leakage through the clearance spaces 154 past the piston head 152. As seen in FIG. 3, the pistons 151*a, b* and *c* of the three cylinders are next to each other but spaced apart by spacer blocks 173. Pin 172 passes through all of the pistons 151 and blocks 173 and they are joined together at driven gear 180 at one end.

In order for the pump to have minimal pressure pulses and to pump water relatively smoothly, as with any piston operated apparatus, the eccentric bushes 168 of each of the cylinders 20, 26, 28 have different relative rotative orientations selected so that the intervals between each piston reaching its points of maximum rise and maximum descent would be spaced and timed uniformly.

A conventional electric motor 182, or the like, is connected to rotate the common crank pin 172 for all pistons to drive the pistons to reciprocate in turn. The motor 182 drives the gear 184 to rotate. Through belt 186, the gear 184 transmits rotary motion to the driven gear 180. Driven gear 180, in turn, is fixed on the pin 172 to rotate the pin which drives the pistons to reciprocate.

As shown in FIG. 5, the entire pressure washer 10 is enclosed within a housing 190. That housing may have any convenient configuration. It is shaped to cover the elements of the pressure washer. It has openings permitting access to the inlet and outlet fittings 14, 56 and to the gauge 126, 127 and is shaped to permit removable mounting of the additional liquid reservoir 53 adjacent the housing 190. That reservoir is replaced when its contents are exhausted so that additional liquid can always be supplied to the pressure washer. Alternatively, the unit may be operable without the additional liquid reservoir in place.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A pressure washer for delivering liquid under pressure, the pressure washer comprising:

an outlet pressure spray nozzle for spraying liquid; an outlet conduit connected for delivering liquid eventually to the outlet pressure spray nozzle;

an inlet conduit for receiving liquid from a liquid supply;

at least one pumping means connected between the inlet conduit and the outlet conduit and operable for continuously pumping liquid from the inlet conduit to the outlet conduit;

spray controlling means for selectively permitting exit of liquid pumped by the pumping means from the outlet conduit and through the pressure spray nozzle and for blocking exit of the continuously pumped liquid from the outlet conduit and through the pressure spray nozzle;

a flow recirculation bypass conduit connected between the inlet conduit and the outlet conduit in parallel to the connections to the inlet and the outlet conduits of each pumping means;

a bypass valve in the bypass conduit for selectively closing and opening the bypass conduit, the bypass valve including a bypass valve seat in the bypass conduit such that flow in the bypass conduit passes the bypass valve seat; a bypass valve element movable toward and liftable away from the bypass valve seat; the bypass valve element being so shaped and the outlet and bypass conduits being so positioned that the valve element may be raised up to a first distance off the bypass valve seat and still substantially block direct liquid flow between the outlet conduit and the bypass conduit;

the bypass valve element being shaped for defining a liquid leakage pathway past the bypass valve element and to an area outside the outlet and the bypass conduits, the liquid leakage pathway being of sufficient size that liquid flowing up to a first flow rate value can pass through the leakage pathway;

bypass biasing means for urging the bypass valve element toward the bypass valve seat at a force such that liquid flowing at a flow rate below the first flow rate value will not raise the bypass valve element more than the first distance to avoid opening communication between the outlet conduit and the bypass conduit;

the bypass valve element communicating through the bypass valve seat with the outlet conduit such that with the spray controlling means permitting exit of liquid through the pressure nozzle, the pressure in the outlet conduit is at most a first pressure and the flow pumped into the outlet conduit is divided between the pressure nozzle and flowing past the bypass valve element at a rate below the first flow rate value, and the bypass biasing means permitting the bypass valve element to lift away from the valve seat to permit flow below the first flow rate to pass along the leakage pathway, and such that with the spray controlling means blocking exit of liquid through the pressure nozzle, the pumped flow in the outlet conduit flows through the bypass valve seat at a rate greater than the first flow rate value and that flow sufficiently raises the bypass valve element off the bypass valve seat against the bias of the bypass biasing means to establish liquid flow communication from the outlet conduit into the bypass conduit and from there into the inlet conduit for recycling liquid back to the pumping means.

2. The pressure washer of claim 1, wherein the bypass valve element has a face toward the bypass valve seat of a first greater cross-section and the bypass valve seat has an opening therethrough of a crosssection smaller than the first cross-section and through which liquid may move, such that with the bypass valve element biased toward the bypass valve seat and the flow rate of liquid past the bypass valve seat below the first flow rate, the flow of liquid raises the bypass valve element off the bypass valve seat sufficiently for some leakage flow to pass the face of the bypass valve element while the bypass biasing means holds the bypass valve element at a position to block flow between the outlet conduit and the bypass conduit, and also such that with flow above the first flow rate, the flow passing the bypass valve seat presses on the full face of the bypass valve element to raise it against the bias of the bypass biasing element over the first distance to permit communication between the outlet conduit and the bypass conduit.

3. The pressure washer of claim 2, wherein the leakage pathway past the bypass valve element comprises a leakage channel through the bypass valve element of a cross-section to allow up to the first flow rate of liquid therethrough.

4. The pressure washer of claim 3, wherein besides the leakage channel, the bypass vale element is otherwise sealed against leakage flow therepast.

5. The pressure washer of claim 2, further comprising a pressure regulator operable for adjusting the biasing force of the bypass biasing means on the bypass valve element.

6. The pressure washer of claim 1, wherein there are a plurality of the pumping means connected in parallel between the inlet conduit and the outlet conduit.

7. The pressure washer of claim 1, further comprising means for introducing an additional liquid into the outlet conduit for mixing with the liquid pumped into the outlet conduit by the pumping cylinders for dispensing the mixed liquids from the pressure nozzle.

8. The pressure washer of claim 7, wherein the means for introducing an additional liquid comprises a venturi in the outlet conduit which is shaped for generating suction in the outlet conduit, and further comprises an additional liquid inlet valve connectable with a supply of additional liquid and communicating into the outlet conduit generally at the venturi; the additional liquid inlet valve comprising a valve element which is biased to close the additional liquid inlet valve under higher pressure in the outlet conduit when the exit of liquid from the pressure nozzle is blocked and which is moved under lower pressure in the outlet conduit when the exit of liquid from the pressure nozzle is permitted to open the additional liquid inlet valve and for drawing the additional liquid into the outlet conduit through the reduced pressure in the outlet conduit near the venturi.

9. The pressure washer of claim 8, wherein there are a plurality of the pumping means connected in parallel between the inlet conduit and the outlet conduit;

the venturi is placed in the outlet conduit away from the connection into the outlet conduit of the bypass conduit and away from the connections of the pumping means into the outlet conduit such that when the bypass valve is opened and liquid flows past the bypass valve seat, the liquid does not flow past the venturi from the pumping cylinders moving toward the bypass conduit.

10. The pressure washer of claim 9, wherein the pumping means are connected in an array in parallel, one after the other, between the inlet and outlet conduits; the bypass conduit is connected between the inlet conduit and the outlet conduit past the pumping means at one side of the array of pumping means and the venturi is disposed in the outlet conduit at the other side of the array of pumping means from the bypass conduit.

11. The pressure washer of claim 1, further comprising a pressure gauge connected into the outlet conduit, the gauge being operable for indicating the pressure in the outlet conduit.

12. The pressure washer of claim 11, wherein the gauge includes a gauge element and a passage through which the gauge element is moveable, the gauge element communicating into the outlet conduit for being moved in one direction along the gauge passage due to the pressure in the outlet conduit, and gauge element biasing means urging the gauge element in the opposite direction along the gauge passage from the direction of movement caused by the outlet conduit pressure.

13. The pressure washer of claim 12, further comprising a pressure gauge disk supported for rotation around an axis, the gauge element communicating eccentrically with the disk for rotating the disk as the gauge element moves, and an indicator disposed on the pressure gauge disk, calibrated for indicating pressure in the outlet conduit.

14. A pressure washer for delivering liquid under pressure, the pressure washer comprising:

an outlet pressure spray nozzle for spraying liquid; an outlet conduit connected for delivering liquid eventually to the outlet pressure spray nozzle;

an inlet conduit for receiving liquid from a liquid supply;

means for selectively permitting exit of liquid pumped through the pressure nozzle and for blocking exit of liquid through the pressure nozzle wherein blocking exit through the pressure nozzle builds up pressure in the outlet conduit;

a plurality of pumping cylinders connected in parallel between the inlet conduit and the outlet conduit;

respective pumping means in each pumping cylinder for continuously pumping liquid from the inlet conduit to the outlet conduit;

an input conduit communicating from the inlet conduit to each pumping cylinder; and output conduit communicating from each pumping cylinder to the outlet conduit;

an input check valve in the input conduit, comprising an input valve seat in the input conduit past which liquid moves, an input valve element in the input conduit and means biasing the input valve element against the input valve seat in a direction for normally blocking passage of liquid through the input conduit, and for enabling the input valve element to raise off the input valve seat upon a reduction of pressure in the respective pumping cylinder;

an output check valve in the output conduit, comprising an output valve seat in the output conduit past which liquid moves through the output conduit, and an output valve element in the output conduit normally biased against the output valve seat, the output valve element being oriented for being raised off the output valve seat upon an increase in pressure in the respective pumping cylinder for raising the output valve element off the output valve seat for pumping liquid from the respective pumping cylinder to the outlet conduit;

a piston in each pumping cylinder movable generally reciprocatingly for increasing and decreasing the volume of the pumping cylinder, with the increase in volume causing reduced pressure in the input conduit for opening the input valve and with the decrease in volume permitting the reclosing of the input valve and causing the opening of the output valve element off the output valve seat;

means for reciprocating the piston in the pumping cylinder;

a flow recirculation bypass conduit connected between the inlet conduit and the outlet conduit in parallel to the connections to the inlet and the outlet conduits of each pumping means;

a bypass valve in the bypass conduit for selectively closing and opening the bypass conduit, the bypass valve including a bypass valve seat in the bypass conduit such that flow in the bypass conduit passes the bypass valve seat; a bypass valve element movable toward and liftable away from the bypass valve seat; the bypass valve element being so shaped and the outlet and bypass conduits being so positioned that the valve element may be raised up to a first distance off the bypass valve seat and still block liquid flow between the outlet conduit and the bypass conduit;

the bypass valve element being shaped for defining a liquid leakage pathway past the bypass valve element and to an area outside the outlet and the bypass conduits, the liquid leakage pathway being of sufficient size that liquid up to a first flow rate can pass through the leakage pathway;

bypass biasing means for urging the bypass valve element toward the bypass valve seat at a pressure such that liquid at a flow rate below the first flow rate will not raise the bypass valve element more than the first distance to avoid opening communication between the outlet conduit and the bypass conduit;

the bypass valve element communicating through the bypass valve seat with the outlet conduit such that with the pressure nozzle permitting exit of liquid through the pressure nozzle, the pressure in the outlet conduit is at most a first pressure and the flow pumped into the outlet conduit is divided between the pressure nozzle and flowing past the bypass valve element at a rate below the first flow rate, and the bypass biasing means permitting the bypass valve element to lift away from the valve seat to permit flow below the first flow rate to pass along the leakage pathway, and such that with the pressure nozzle permitting means blocking exit of liquid through the pressure nozzle, the pumped flow in the outlet conduit flows through the bypass valve seat at a rate greater than the first flow rate and that flow sufficiently raises the bypass valve element off the bypass valve seat against the bias of the bypass biasing means to establish liquid flow communication from the outlet conduit into the bypass conduit and from there into the inlet conduit for recycling liquid back to the pumping means.

15. The pressure washer of claim 14, wherein the means for reciprocating the piston in the pumping cylinder comprises a rotatable crank pin on an axis; the piston being connected with the crank pin eccentrically of the axis of the crank pin such that rotation of the crank pin moves the end of the piston in an annular pathway around the axis of the crank pin for reciprocating the piston in the pumping cylinder to alternately increase and decrease the volume of the pumping cylinder.

16. The pressure washer of claim 15, further comprising the piston having a piston head end inside the pumping cylinder and having a piston rod behind the head end, the pumping cylinder and the piston being respectively so shaped that the piston engages the pumping cylinder seal to define a fulcrum for the piston about which the piston inclines laterally first in one direction and then in the other direction as the piston reciprocates as it is moved eccentrically around the crank pin.

17. The pressure washer of claim 15, wherein the eccentric connection of the piston to the crank pin comprises an eccentric bush around the crank pin and rotatable therewith, a ball race around the eccentric bush for moving eccentrically with the bush, the piston being connected with the ball race, such that as the crank pin and the eccentric bush rotate together, the piston moves eccentrically without rotating and the relative motion of the eccentric bush with respect to the piston is taken up by the ball race.

18. The pressure washer of claim 17, wherein there are a plurality of the pumping cylinders connected in parallel between the inlet conduit and the outlet conduit.

19. The pressure washer of claim 18, wherein each of the pumping cylinders has a respective eccentric connection to the crank pin and all eccentric connections are rotated by the common crank pin, the eccentric connections of each of the pistons being angularly offset around the axis of the crank pin for the pistons to operate in sequence in their respective pumping cylinders.

20. The pressure washer of claim 15, wherein the piston in the pumping cylinder is of narrower cross-section than the cross-section of the pumping cylinder for enabling the piston to move laterally in the pumping cylinder as the piston is moved on the eccentric pathway.

21. The pressure washer of claim 20, further comprising a seal around the piston in the pumping cylinder for closing the pumping cylinder against leakage therefrom past the piston while permitting the piston to reciprocate and to move laterally in the pumping cylinder.

* * * * *